US007426967B2

(12) United States Patent
Sugiura

(10) Patent No.: US 7,426,967 B2
(45) Date of Patent: Sep. 23, 2008

(54) ROTARY STEERABLE TOOL INCLUDING DRILL STRING ROTATION MEASUREMENT APPARATUS

(75) Inventor: Junichi Sugiura, Houston, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 396 days.

(21) Appl. No.: 11/273,692

(22) Filed: Nov. 14, 2005

(65) Prior Publication Data

US 2007/0107937 A1 May 17, 2007

(51) Int. Cl.
*E21B 7/04* (2006.01)

(52) U.S. Cl. ..... 175/38; 175/45; 175/61

(58) Field of Classification Search ..... 175/38, 175/45, 48, 61, 62; 702/9; 73/152.46
See application file for complete search history.

(56) References Cited

U.S. PATENT DOCUMENTS

| | | | |
|---|---|---|---|
| 5,603,386 | A | 2/1997 | Webster |
| 6,092,610 | A | 7/2000 | Kosmala et al. |
| 6,216,802 | B1 | 4/2001 | Sawyer |
| 6,267,185 | B1 | 7/2001 | Mougel et al. |
| 6,268,726 | B1 | 7/2001 | Prammer et al. |
| 6,427,783 | B2 | 8/2002 | Krueger et al. |
| 6,518,756 | B1 | 2/2003 | Morys et al. |
| 6,608,565 | B1 | 8/2003 | Van Steenwyk et al. |
| 6,742,604 | B2 | 6/2004 | Brazil et al. |
| 7,222,681 | B2 * | 5/2007 | Jones et al. ..... 175/38 |
| 7,245,229 | B2 * | 7/2007 | Baron et al. ..... 340/853.3 |
| 2004/0222019 | A1 | 11/2004 | Estes et al. |
| 2004/0251898 | A1 | 12/2004 | Morys et al. |
| 2005/0001737 | A1 | 1/2005 | Baron et al. |
| 2005/0034985 | A1 | 2/2005 | Zamanzadeh et al. |
| 2005/0150694 | A1 | 7/2005 | Schuh |
| 2006/0185900 | A1 * | 8/2006 | Jones et al. ..... 175/26 |
| 2007/0289373 | A1 * | 12/2007 | Sugiura ..... 73/152.46 |

FOREIGN PATENT DOCUMENTS

| | | |
|---|---|---|
| GB | 2356207 A | 5/2001 |
| GB | 2406344 A | 3/2005 |
| GB | 2424907 A | 10/2006 |

* cited by examiner

*Primary Examiner*—William P Neuder

(57) ABSTRACT

Aspects of this invention include a downhole tool (such as a steering tool) including first and second sensor sets for measuring substantially instantaneous drill string rotation rates. Each of the sensor sets includes at least one accelerometer disposed to measure cross-axial acceleration components. Embodiments of this invention advantageously enable gravitational and tool shock/vibration acceleration components to be cancelled out, thereby improving accuracy. Moreover, exemplary embodiments of this enable stick/slip conditions to be detected and accommodated.

37 Claims, 6 Drawing Sheets

ROTARY STEERABLE TOOL INCLUDING DRILL STRING ROTATION MEASUREMENT APPARATUS

RELATED APPLICATIONS

None.

FIELD OF THE INVENTION

The present invention relates generally to downhole tools, for example, including three-dimensional rotary steerable tools (3DRS). More particularly, embodiments of this invention relate to a sensor arrangement configured to measure a substantially real-time rotation rate of a downhole tool. In certain exemplary embodiments, this invention relates to a rotary steerable tool including an arrangement of sensors configured to measure a drill string rotation rate.

BACKGROUND OF THE INVENTION

Directional control has become increasingly important in the drilling of subterranean oil and gas wells, for example, to more fully exploit hydrocarbon reservoirs. Two-dimensional and three-dimensional rotary steerable tools are used in many drilling applications to control the direction of drilling. Such steering tools commonly include a plurality of force application members (also referred to herein as blades) that may be independently extended out from and retracted into a housing. The blades are disposed to extend outward from the housing into contact with the borehole wall and to thereby displace the housing from the centerline of a borehole during drilling. The housing is typically deployed about a shaft, which is coupled to the drill string and disposed to transfer weight and torque from the surface (or from a mud motor) through the steering tool to the drill bit assembly.

While such steering tools are conventional in the art and are known to be serviceable for many directional drilling applications, there is yet room for further improvement. In particular, directional drilling operations may be enhanced by improved control of the steering tool. The ability to quickly and reliably transmit steering tool commands from an operator at the surface to a downhole steering tool may advantageously enhance the precision of a directional drilling operation. For example, the ability to continuously adjust the drilling direction by sending commands to a steering tool may enable an operator to fine tune the well path based on substantially real-time survey and/or logging-while-drilling data.

Prior art communication techniques that rely on the rotation rate of the drill string to encode steering tool commands are known. For example, Webster, in U.S. Pat. No. 5,603,386, discloses a method in which the absolute rotation rate of the drill string is utilized to encode tool commands. Webster discloses a pressure sensor, located on the output line of a hydraulic pump, or alternatively a Hall-effect sensor, to assess the rotational speed of the drill string. Barron et al., in U.S. Publication No. 2005/0001737, disclose an encoding scheme in which a difference between first and second rotation rates is utilized to encode commands. A magnetic marker located on the driveshaft and a Hall-effect sensor deployed on the housing are utilized to determine rotation rate of the drill string. While these prior art approaches are known to be serviceable, they may be improved upon for certain directional drilling application.

For example, in some applications, steering tool commands may be advantageously transmitted downhole immediately after a new section of drill pipe has been added to the drill string and an MWD survey has been received at the surface. In such applications, the housing is known to sometimes rotate with respect to the borehole (since the drill bit is typically off bottom and the blades may be somewhat disengaged from the borehole wall). Rotation of the housing, if not accounted, can introduce errors into the aforementioned drill string rotation rate measurements (which measure the rotation rate of the shaft with respect to the housing), thereby potentially resulting, for example, in miscommunication of a steering tool command. Such miscommunication requires retransmission of the command, which wastes valuable rig time. Miscommunication of a steering command may also occasionally have more serious consequences, such as drilling the well in the wrong direction.

Furthermore, drilling conditions are often encountered in which the drill string sticks and/or slips in the borehole. This is a condition known in the art and commonly referred to as stick/slip. In stick/slip situations, precise measurement of the drill string rotation rate is often problematic because the rotation rate is not constant in time. Stick/slip conditions therefore present difficulties to the timely and accurate transmission of steering tool commands downhole.

Other downhole tools, including, for example, MWD and LWD tools, may also benefit from the measurement of instantaneous (substantially real-time) rotation rates. For example, such measurements may improve the reliability of survey and LWD data.

Therefore, there exists a need for an improved mechanism for measuring substantially real-time rotation rates of downhole tools. For example, for steering tool embodiments, a mechanism that enables substantially instantaneous rotation rates to be measured would advantageously enhance communication between the surface and the downhole steering tool.

SUMMARY OF THE INVENTION

The present invention addresses one or more of the above-described drawbacks of prior art downhole tools and, in exemplary embodiments, methods of communicating therewith. Aspects of this invention include a downhole tool having one or more improved sensor arrangements for measuring substantially instantaneous drill string rotation rates. In one exemplary embodiment, a steering tool in accordance with this invention includes first and second rotation rate sensors, the first sensor disposed to measure a difference in rotation rates between a drive shaft and an outer housing and the second sensor disposed to measure the rotation rate of the outer housing. The first sensor typically includes a Hall-effect sensor or some other conventional arrangement. The second sensor includes first and second sensor sets, each of which includes at least one accelerometer disposed to measure cross-axial acceleration components.

In another exemplary embodiment, a downhole tool in accordance with the present invention includes a rotation rate sensor deployed in a portion of the tool that rotates with the drill string. The rotation rate sensor includes first and second sensor sets deployed in a tool housing, each sensor set including at least one accelerometer disposed to measure a cross-axial acceleration component. In one exemplary embodiment the first sensor set is located a greater distance from a longitudinal axis of the tool than the second sensor set. In another exemplary embodiment, the first and second sensor sets are separated by an angle of less than 180 degrees about the longitudinal axis.

Exemplary embodiments of the present invention may advantageously provide several technical advantages. For example, in one exemplary steering tool embodiment, rotation rate sensors provide for both drive shaft and housing rotation rates to be measured. Moreover, sensor arrangements according to this invention enable gravitational and tool shock/vibration acceleration components to be cancelled out. Therefore, the resulting rotation rate measurements tend to have improved accuracy. Such improved accuracy tends to advantageously improve the accuracy and speed of downhole communication techniques that rely on drill string rotation rate encoding. Exemplary embodiments in accordance with this invention also provide for substantially instantaneous rotation rate measurement, thereby enabling stick/slip conditions to be detected and accommodated.

In one aspect the present invention includes a downhole steering tool configured to operate in a borehole. The steering tool includes a shaft, a housing deployed about the shaft, the housing and shaft disposed to rotate substantially freely with respect to one another, and a plurality of blades deployed on the housing, the blades disposed to extend radially outward from the housing and engage a wall of the borehole, the engagement of the blades with the borehole wall operative to eccenter the housing in the borehole. The steering tool further includes first and second sensor sets deployed at corresponding first and second positions in the housing and disposed, in combination, to measure a substantially real-time rotation rate of the housing in the borehole, each of the sensor sets including at least one accelerometer disposed to measure a cross-axial acceleration component.

In another aspect the present invention includes a downhole tool. The downhole tool includes a housing including a longitudinal axis, the housing configured for being coupled to and rotating with a drill string in a subterranean borehole. First and second sensor sets are deployed in the housing and disposed, in combination, to measure a substantially real-time rotation rate of the housing about the longitudinal axis. In one exemplary embodiment, the first sensor set is located a first distance from the longitudinal axis and the second sensor set is located a second distance from the longitudinal axis, the first distance being greater than the second distance. In such an embodiment each of the sensor sets includes at least one accelerometer disposed to measure cross-axial acceleration components in the housing. In another exemplary embodiment, the first and second sensor sets are deployed at a known angle with respect to one another about the longitudinal axis, the known angle being less than 180 degrees. In such an embodiment, each of the sensor sets includes first and second accelerometers disposed to measure cross-axial acceleration components in the housing.

In still another aspect the present invention includes a method of communicating a wakeup command to a steering tool deployed in a subterranean borehole. The method includes deploying a drill string in a subterranean borehole, the drill string including a steering tool connected thereto. The drill string is rotatable about a longitudinal axis and the steering tool includes shaft deployed to rotate substantially freely in a housing. The steering tool further includes a first rotation measurement device operative to measure a difference in rotation rates between the shaft and the housing and a second rotation measurement device operative to measure a rotation rate of the housing. The second rotation measurement device includes a plurality of accelerometers, each of which is disposed to measure cross-axial acceleration components. The method further includes predefining an encoding language comprising codes understandable to the steering tool, the codes represented in said language as predefined value combinations of drill string rotation variables, the drill string rotation variables including first and second drill string rotation rates. The method still further includes causing the drill string to rotate through a predefined sequence of varying rotation rates, such sequence representing the wakeup command, causing the first rotation measurement device to measure the difference in rotation rates between the shaft and the housing, and causing the second rotation measurement device to measure the rotation rate of the housing. The method yet further includes processing downhole the difference in rotation rates and the rotation rate of the housing to determine a rotation rate of the drill string and processing downhole the rotation rate of the drill string to acquire the wakeup command.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
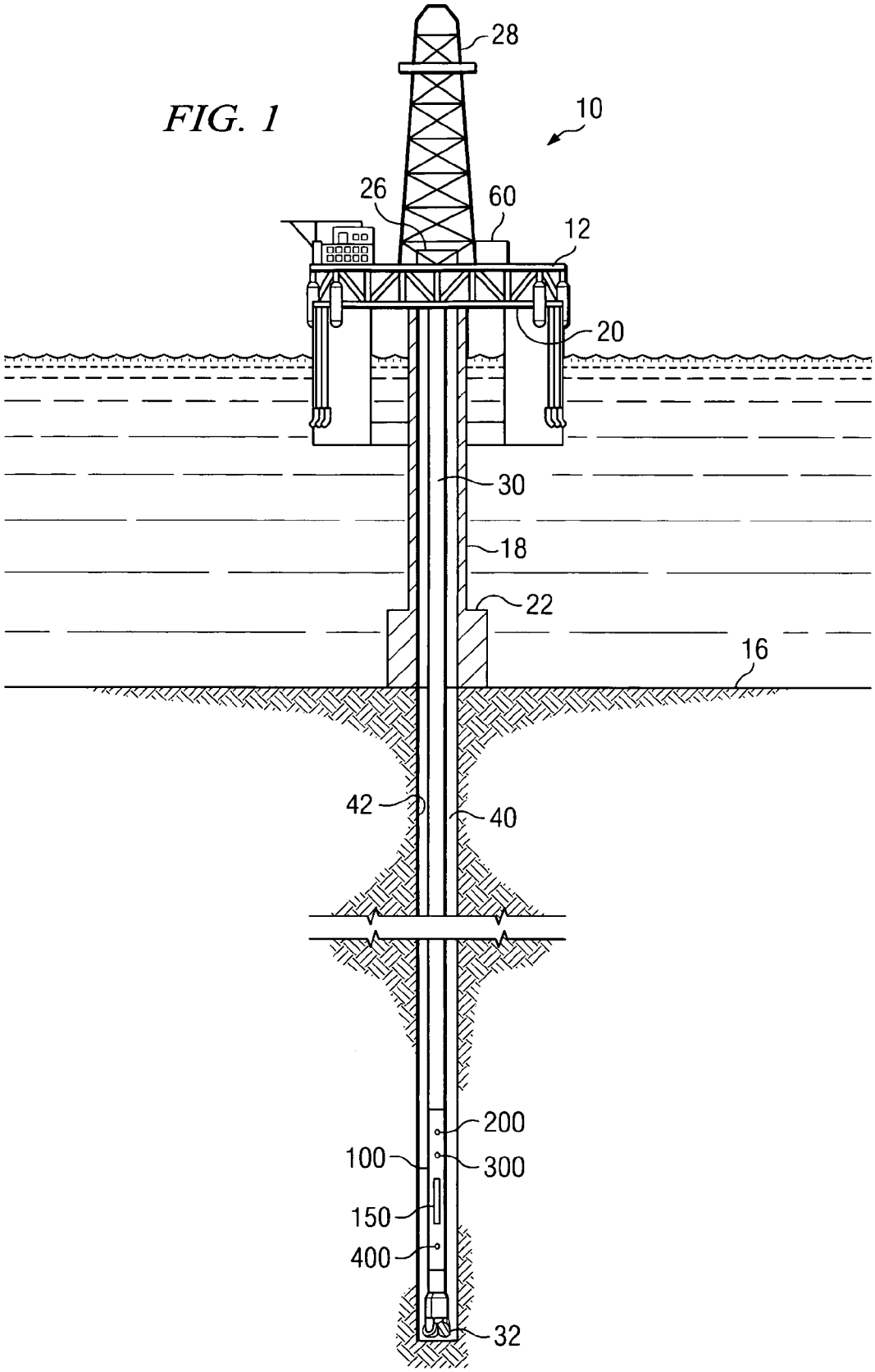
FIG. 1 depicts a drilling rig on which exemplary embodiments of the present invention may be deployed.

Referring to FIGS. 1 through 8, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 8 may be described herein with respect to that reference numeral shown on other views.

FIG. 1 illustrates a drilling rig 10 suitable for utilizing exemplary downhole tool and communication method embodiments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a directional drilling tool 100 (such as a three-dimensional rotary steerable tool). In the exemplary embodiment shown, directional drilling tool 100 (also referred to herein as steering tool 100) includes one or more (e.g., three) blades 150 disposed to extend outward from the tool 100 and apply a lateral force and/or displacement to the borehole wall 42 in order to deflect the drill string 30 from the central axis of the borehole 40 and thus change the drilling direction. Exemplary embodiments of steering tool 100 further include first and second sensor arrangements 200 and 300, which may be utilized in combination to measure the rotation rate of the drill string 30. Other exemplary embodiments of steering tool 100 may utilize rotation rate sensor 400 in place of sensors 200 and 300 to measure the rotation rate of the drill string 30. Rig 10 may further include a transmission system 60 for controlling, for example, the rotation rate of drill string 30. Such devices may be computer controlled or manually operated. Drill string 30 may further include a downhole drilling motor, a mud pulse telemetry system, and one or more additional sensors, such as LWD and/or MWD tools for sensing downhole characteristics of the borehole and the surrounding formation. The invention is not limited in these regards.

It will be understood by those of ordinary skill in the art that methods and apparatuses in accordance with this invention are not limited to use with a semisubmersible platform 12 as illustrated in FIG. 1. This invention is equally well suited for use with any kind of subterranean drilling operation, either offshore or onshore.

With continued reference to FIG. 1, it will be appreciated that in certain method embodiments of this invention the drill string 30 provides a physical medium for communicating information from the surface to steering tool 100. As described in more detail below, the rotation rate of drill string 30 has been found to be a reliable carrier of information from the surface to the steering tool 100 (which is located downhole). Although changes in rotation rate may take time to traverse several thousand meters of drill pipe, the relative waveform characteristics of pulses including encoded data and/or commands are typically reliably preserved. For example, a sequence of rotation rate pulses has been found to traverse the drill string with sufficient accuracy to generally allow both rotation rate and relative time relationships within the sequence to be utilized to reliably encode data and/or commands.

Embodiments of this invention may utilize substantially any transmission system 60 for controlling the rotation rate of drill string 30. For example, transmission system 60 may employ manual control of the rotation rate, for example, via known rheostatic control techniques. On drilling rigs including such manual control mechanisms, rotation rate encoded data in accordance with this invention may be transmitted by manually adjusting the rotation rates, e.g., in consultation with a timer. Alternatively, transmission system 60 may employ computerized control of the rotation rate. In such systems, an operator may input a desired rotation rate via a suitable user interface such as a keyboard or a touch screen. In one advantageous embodiment, transmission system 60 may include a computerized system in which an operator inputs the command to be transmitted. For example, for a downhole steering tool, an operator may input desired tool face and offset values. The transmission system 60 then determines a suitable sequence of rotation rate changes and executes the sequence to transmit the command to the tool 100.

Figure 2:
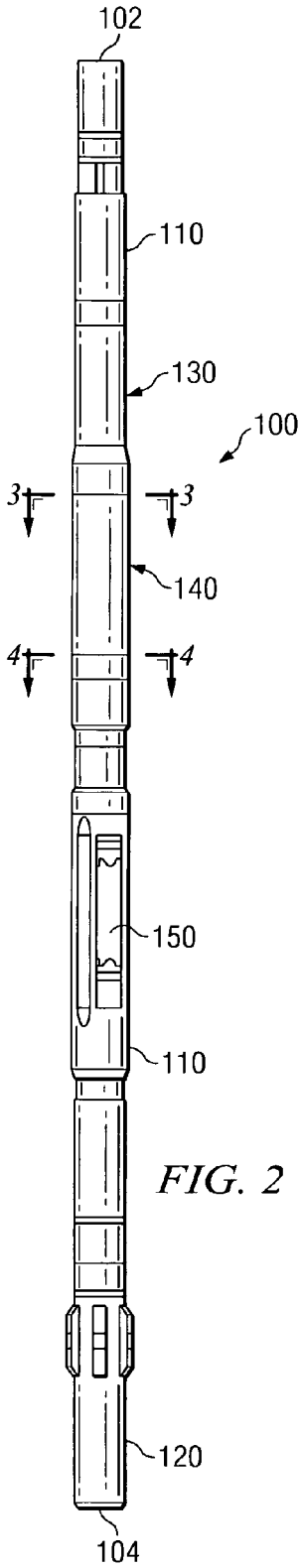
FIG. 2 is a perspective view of the steering tool shown on FIG. 1.

Turning now to FIG. 2, one exemplary embodiment of downhole steering tool 100 from FIG. 1 is illustrated in perspective view. In the exemplary embodiment shown, steering tool 100 is substantially cylindrical and includes threaded ends 102 and 104 (threads not shown) for connecting with other bottom hole assembly (BHA) components (e.g., connecting with the drill bit at end 104). The steering tool 100 further includes a housing 110 and at least one blade 150 deployed, for example, in a recess (not shown) in the housing 110. Steering tool 100 further includes hydraulics 130 and electronics 140 modules (also referred to herein as control modules 130 and 140) deployed in the housing 110. In general, the control modules 130 and 140 are configured for sensing and controlling the relative positions of the blades 150 and may include substantially any devices known to those of skill in the art, such as those disclosed in U.S. Pat. No. 5,603,386 to Webster or U.S. Pat. No. 6,427,783 to Krueger et al.

To steer (i.e., change the direction of drilling), one of more blades 150 are extended and exert a force against the borehole wall. The steering tool 100 is moved away from the center of the borehole by this operation, and the drilling path is altered. It will be appreciated that the tool 100 may also be moved back towards the borehole axis if it is already eccentered. To facilitate controlled steering, the tool 100 is constructed so that the housing 110, which houses the blades 150, remains stationary, or substantially stationary, with respect to the borehole during steering operations. If the desired change in direction requires moving the center of the steering tool 100 a certain direction from the centerline of the borehole, this objective is achieved by actuating one or more of the blades 150. By keeping the blades 150 in a substantially fixed position with respect to the circumference of the borehole (i.e., by preventing rotation of the housing 110), it is possible to steer the tool without constantly extending and retracting the blades 150. The housing 110, therefore, is constructed in a nonfixed or floating fashion.

The rotation of the drill string and the drilling force it exerts are transmitted through the steering tool 100 by a shaft 115. The shaft 115 is typically a thick-walled, tubular member capable of withstanding the large forces encountered in drilling situations. The tubular shaft 115 typically includes a relatively small bore that is required to allow flow of drilling fluid to the drill bit 32.

Though the housing 110 is not rigidly coupled to the drill string 30 or the shaft 115, the housing 110 will often rotate during drilling operations. When the blades 150 are retracted, the housing 110 may rotate with the drill string. Rotation of the housing often occurs when the steering tool 100 is in a near-vertical alignment. In other words, when the borehole is close to vertical, and the blades 150 are retracted, the housing 110 may not be in contact with the borehole wall. When this condition exists, there may be insufficient drag or friction between the housing 110 and the borehole immediately outside the housing 110 to prevent rotation of the housing 110. If, however, the borehole is substantially deviated from vertical, the steering tool 100 may tend to rest or slide along the low side of the borehole due to the force of gravity. When this happens, the housing 110 may be in contact with the borehole wall even when the blades 150 are retracted. In such instances, friction between the tool 100 and the borehole wall may hinder rotation of the housing 110. In this condition, the housing 110 may or may not rotate with the drill string 30, may rotate intermittently, or may even rotate in the opposite direction as the drill string.

The preceding explanation indicates the variability of the rotation of the housing 110 during normal drilling operations. During the course of a normal drilling job, the housing 110 may rotate at the same speed, or close to the same speed, as the drill string 30 at times, and may not rotate at all at other times. It is not practical, and may not be possible, to reliably predict the difference between the rotation rate of the drill string 30 and the housing 110. This fact poses a challenge to steering tools of the type described herein, to the extent that such tools rely on rotation rate and changes in rotation rate as command signals. It is the rotation rate of the drill string 30 that is controlled by the driller. The drill string rotation rate may be varied, as explained above, to send command signals to the steering tool 100. The control sensors and electronics in the steering tool 100, however, are typically located in the housing 110. It is necessary, therefore, to determine a configuration and method of accurately determining the drill string rotation rate using sensors located in the nonfixed housing 110. If rotation rate of the housing 110 is designated as $R_H$, and difference between the rotation rates of the shaft 115 and the housing 110 may be designated as $R_{S-H}$, then the rotation rate of the drill string may be determined as follows.

$$\vec{R}_{DS}=\vec{R}_{S-H}+\vec{R}_{H} \qquad \text{Equation 1}$$

It will be appreciated by those of ordinary skill in the art that Equation 1 is written in vector form, because rotation of the housing and the drill string are not necessarily in the same direction. When the housing rotates in the same direction as the drill string, the drill string rotation rate is equal to the sum of the absolute values of $R_{S-H}$ and $R_H$. When the housing rotates in the opposite direction as the drill string, the drill string rotation rate is equal to the difference between $R_{S-H}$ and $R_H$.

To illustrate, assume the drill string 30 is rotating clockwise at 100 rpm. If the housing 110 is rotating clockwise at 20 rpm, then the difference between the rotation rates of the shaft 115 and the housing 110 is 80 rpm. The drill string rotation rate is then equal to the sum of the absolute values of the two measured rotation rates ($R_{S-H}+R_H$). If the housing is rotating counterclockwise at 20 rpm, then the difference between the rotation rates of the shaft 115 and the housing 110 is 120 rpm. The drill string rotation rate is then equal to the difference between the absolute values of the two measured rotation rates ($R_{S-H}-R_H$).

This may seem to be a backwards means of calculating the rotation rate of the drill string, but it must be understood that a steering tool 100 having sensors and electronics located in the housing 110, has no direct means of determining the rotation rate of the shaft 115 or drill string 30. It is possible, however, to use sensors in the housing 110 to determine the rotation rate of the housing 110 and the difference between the rotation rate of the shaft 115 and the housing 110. Thus, the backwards calculation provides a real-world solution to the challenge. To make this solution work, however, requires an accurate means to determine both the rotation rate of the housing 110 and the difference between that rate and the rotation rate of the shaft 115.

Figure 3:
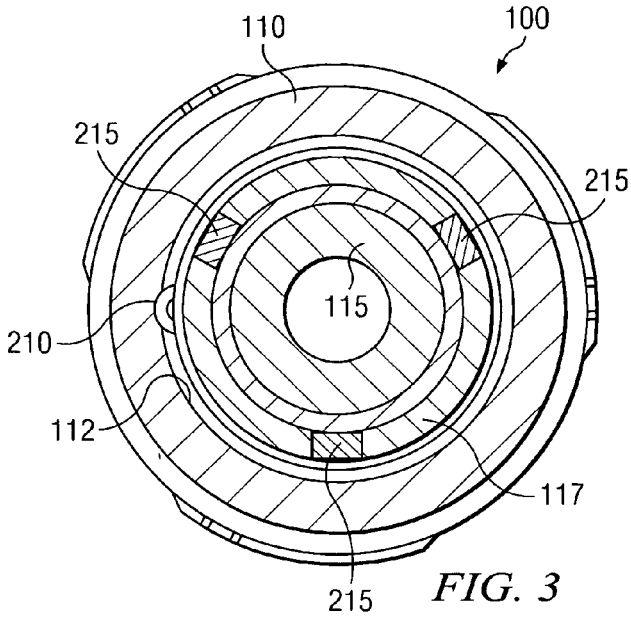
FIG. 3 depicts, in cross section, a portion of the steering tool shown on FIG. 2 showing an exemplary sensor arrangement in accordance with this invention
Figure 4:
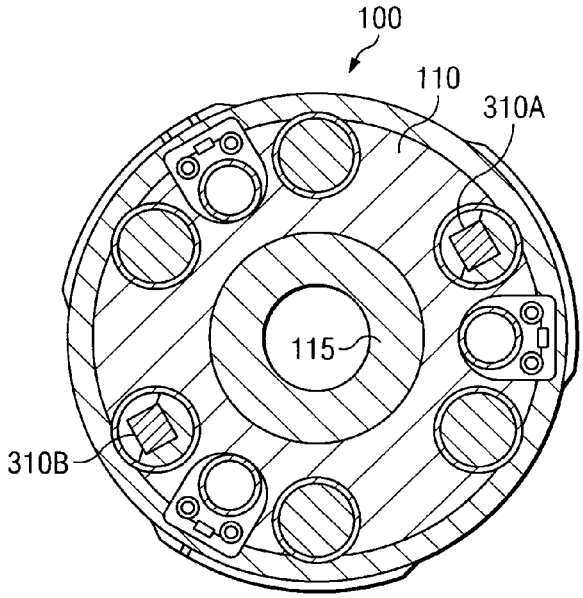
FIG. 4 depicts, in cross section, another portion of the steering tool shown on FIG. 2 showing another exemplary sensor arrangement in accordance with this invention.

FIGS. 3 and 4 show exemplary embodiments of sensor arrangements used to determine rotation rates. A cross section of one exemplary embodiment of sensor arrangement 200 is shown in FIG. 3. The sensor arrangement 200 is disposed to measure the difference in rotation rates of the shaft 115 and the housing 110. In the exemplary embodiment shown on FIG. 3, sensor arrangement 200 includes a Hall-effect sensor 210 deployed on an inner surface 112 of the housing 110. Sensor arrangement 200 further includes a plurality of magnetic markers 215 deployed in a ring member 117 about the shaft 115. In use, Hall-effect sensor 210 sends a pulse to a controller (described in more detail below) each time one of the magnetic markers 215 rotates by the sensor 210. The controller then typically calculates the difference between the rotation rates of the shaft 115 and the housing 110 based upon the time interval between sequential pulses. It will be appreciated that sensor arrangement 200 is not limited to any number of magnetic markers 215. Furthermore, in alternative embodiments, the Hall-effect sensor may be deployed on the shaft 115 and the magnetic markers may be deployed on the housing 110.

Moreover, it will further be appreciated that sensor arrangement 200 is not limited to a Hall-effect sensor 210 and magnetic markers 215 as shown on FIG. 3. Rather, substantially any suitable sensor arrangement may be utilized. For example, in one alternative embodiment, sensor arrangement 200 may include an infrared sensor configured to sense a marker including, for example, a mirror reflecting infrared radiation from a source located near the sensor. An ultrasonic sensor may also be employed with a suitable marker. A pressure sensor deployed in the hydraulic module 130 (FIG. 2) may also be utilized, for example, as disclosed by Webster in U.S. Pat. No. 5,603,386. The invention is not limited in these regards.

Referring now to FIG. 4, one exemplary embodiment of sensor arrangement 300 is shown in cross section. Sensor arrangement 300 is disposed to measure the rotation rate of the housing 110. In the exemplary embodiment shown on FIG. 4, sensor arrangement 300 includes first and second sensor sets 310A and 310B deployed in the housing 110. Each sensor set 310A and 310B includes at least one accelerometer disposed to measure at least one cross-axial component of the housing acceleration. In the exemplary embodiment shown, sensor sets 310A and 310B are diametrically opposed from one another, although the invention is not limited in this regard as described in more detail below. As also described in more detail below, the accelerometer arrangements described herein advantageously enable the contributions of tangential, centripetal, and gravitational accelerations to be uniquely determined.

Figure 5:
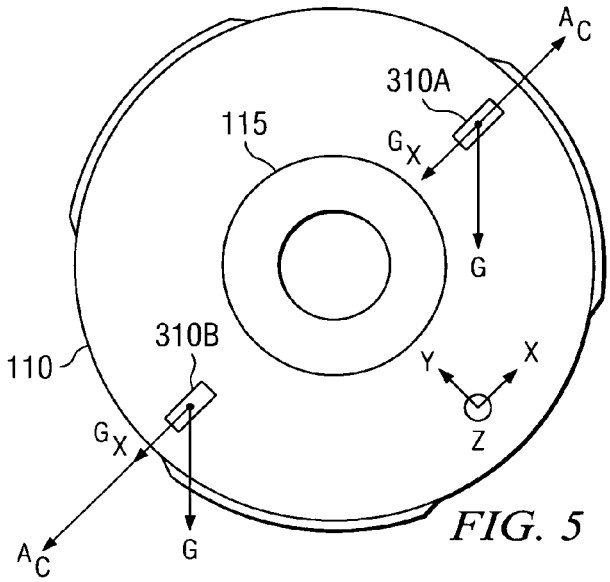
FIG. 5 depicts, in cross section, a schematic arrangement of accelerometers in accordance with the present invention.
Figure 6:
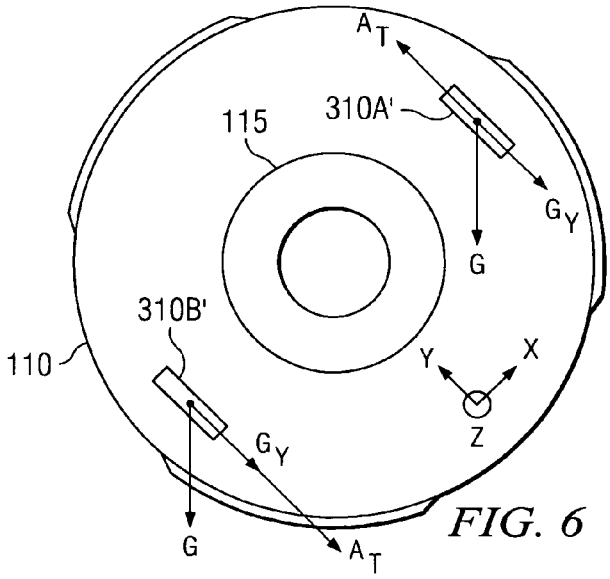
FIG. 6 depicts, in cross section, another schematic arrangement of accelerometers in accordance with the present invention.

With reference now to FIGS. 5 and 6, schematic cross sectional representations of two exemplary embodiments of sensor arrangement 300 are shown. In the exemplary embodiment shown on FIG. 5, each sensor set 310A and 310B includes a single accelerometer aligned radially in the housing 110 and disposed to measure centripetal acceleration $A_C$. In the exemplary embodiment shown on FIG. 6, each sensor set 310A' and 310B' includes a single accelerometer aligned tangentially in the housing and disposed to measure tangential acceleration $A_T$. It will be appreciated that this invention is not limited to tangential and/or radial alignment of the accelerometers. For example, alternative embodiments may include accelerometers deployed at a known angle relative to the tangential and radial directions. In such an arrangement, accelerometer measurements may be resolved into tangential and radial components using known trigonometric techniques. Reference coordinates, including x, y, and z axes, and the x and y components of the gravitational acceleration ($G_X$ and $G_Y$) are also shown on FIGS. 5 and 6. The z-axis will be understood to be aligned with the longitudinal axis of the tool 100.

With reference now to FIG. 5, the total acceleration measured at each accelerometer in sensor sets 310A and 310B may be expressed as follows:

$$A_{X1}=A_C-G_X \quad \text{Equation 2}$$

$$A_{X2}=-A_C G_X \quad \text{Equation 3}$$

where $A_{X1}$ and $A_{X2}$ represent the total acceleration measured along the x axis at the first and second sensor sets (310A and 310B), $A_C$ represents the centripetal acceleration (resulting, for example, from rotation of housing 110 in the borehole), and $G_X$ represents the x component of the total gravitational acceleration G.

The gravitational component, $G_X$, may be canceled out by subtracting Equation 3 from Equation 2. The centripetal component of the total measured acceleration may then be expressed, for example, as follows:

$$A_C = \frac{A_{X1} - A_{X2}}{2} \quad \text{Equation 4}$$

where, as stated above, $A_C$ represents the centripetal acceleration and $A_{X1}$ and $A_{X2}$ represent the total acceleration measured along the x axis at the first and second sensor sets (310A and 310B).

With continued reference to FIG. 5, it will be understood to those of ordinary skill in the art, that centripetal acceleration component $A_C$ may be utilized to determine the rotation rate of the housing 110 in the borehole. For example, the absolute value of the rotation rate $R_H$ may be expressed in units of revolutions per minute as follows:

$$|R_H| = \frac{30}{\pi}\sqrt{\frac{A_C}{d}} = \frac{30}{\pi}\sqrt{\frac{A_{X1} - A_{X2}}{2d}} \quad \text{Equation 5}$$

where d represents the radial distance between each of the sensor sets 310A and 310B and the longitudinal axis of the steering tool 100, and $A_C$, $A_{X1}$, and $A_{X2}$ are as defined above with respect to Equations 2 and 3.

With reference now to FIG. 6, the total acceleration measured at each accelerometer in sensor sets 310A' and 310B' may be expressed as follows:

$$A_{Y1}=A_T-G_Y \quad \text{Equation 6}$$

$$A_{Y2}=A_T-G_Y \quad \text{Equation 7}$$

where $A_{Y1}$ and $A_{Y2}$ represent the total acceleration measured along the y axis at the first and second sensor sets (310A' and 310B'), $A_T$ represents the tangential acceleration (resulting, for example, from an increase or decrease in the rotation rate of the housing 110), and $G_Y$ represents the y component of the gravitational acceleration G.

The gravitational component, $G_Y$, may be canceled out by subtracting Equation 7 from Equation 6. The tangential component of the total measured acceleration may then be expressed, for example, as follows:

$$A_T = \frac{A_{Y1} - A_{Y2}}{2} \quad \text{Equation 8}$$

where, as stated above, $A_T$ represents the tangential acceleration, and $A_{Y1}$ and $A_{Y2}$ represent the total acceleration measured along the y axis at the first and second sensor sets (310A' and 310B').

With continued reference to FIG. 6, it will be understood to those of ordinary skill in the art, that the tangential acceleration component $A_T$ may also be utilized to determine the rotation rate of the housing 110 in the borehole. For example, the rotation rate $R_H$ may be expressed in units of revolutions per minute as follows:

$$R_H = \frac{30}{\pi d}\int A_T dt = \frac{15}{\pi d}\int (A_{Y1} - A_{Y2}) dt \quad \text{Equation 9}$$

where d represents the radial distance between each of the sensor sets 310A' and 310B' and the longitudinal axis of the steering tool 100, $A_T$, $A_{Y1}$, and $A_{Y2}$ are as defined above with respect to Equations 6 and 7, and $\int A_T dt$ represents the integral of the tangential acceleration as a function of time.

With reference now to both FIGS. 5 and 6, the centripetal and tangential components of the total acceleration may also be canceled out, for example, by adding Equations 2 and 3 and Equations 6 and 7. The gravitational acceleration components $G_X$ and $G_Y$ may then be expressed, for example, as follows:

$$G_X = \frac{-A_{X1} - A_{X2}}{2} \quad \text{Equation 10}$$

$$G_Y = \frac{-A_{Y1} - A_{Y2}}{2} \quad \text{Equation 11}$$

where $G_X$ and $G_Y$ represent the x and y components of the gravitational field and $A_{X1}$, $A_{X2}$, $A_{Y1}$, and $A_{Y2}$ are as defined above with respect to Equations 2, 3, 6, and 7. $G_X$ and $G_Y$ may then be utilize to determine borehole inclination and gravity tool face, for example, as follows:

$$Inc = \arcsin\left(\frac{\int_0^{n\pi} |G_X|}{0.6366}\right) = \arcsin\left(\frac{\int_0^{n\pi} |G_Y|}{0.6366}\right) \quad \text{Equation 12}$$

$$GTF = \arccos\left(\frac{G_X}{\sin Inc}\right) = \arcsin\left(\frac{G_Y}{\sin Inc}\right) \quad \text{Equation 13}$$

where Inc represents the borehole inclination, GTF represents the gravity tool face, and 0.6366 represents the average value of the absolute value of a sine wave.

With continued reference to FIGS. 5 and 6, it will be appreciated that it is not necessary to deploy sensor sets 310A and 310B (or sensor sets 310A' and 310B') the same distance from the longitudinal axis of the steering tool 100 as shown and described above. Provided that the distance to the longitudinal axis is known for each sensor set, sensor sets 310A and 310B may be deployed substantially any distance from the central axis of the tool. For exemplary embodiments in which sensor sets 310A and 310B are located distances $d_1$ and $d_2$ from the longitudinal axis (where $d_1 \geqq d_2$), $A_{C1}$ and $A_{T1}$ (the centripetal and tangential accelerations at the first sensor set) may be expressed, for example, as follows:

$$A_{C1} = \frac{d_1}{d_1 + d_2}(A_{X1} - A_{X2}) \quad \text{Equation 14}$$

$$A_{T1} = \frac{d_1}{d_1 + d_2}(A_{Y1} - A_{Y2}) \quad \text{Equation 15}$$

Figure 7:
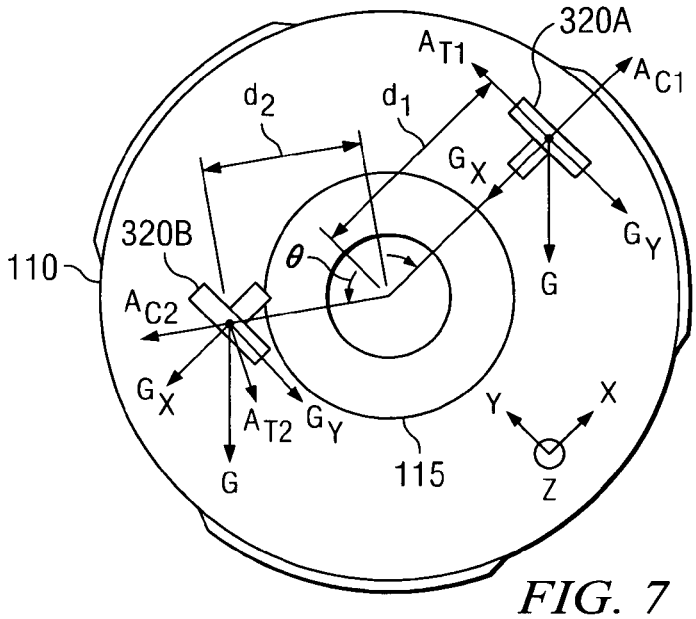
FIG. 7 depicts, in cross section, still another schematic arrangement of accelerometers in accordance with the present invention.

Referring now to FIG. 7, exemplary embodiments of sensor arrangement 300 may include sensor sets 320A and 320B, each of which has at least two orthogonal accelerometers deployed therein and disposed to measure cross-axial acceleration components. It will be appreciated that sensor sets 320A and 320B may be located at substantially any suitable positions in the housing 110, provided that (i) the corresponding distances $d_1$ and $d_2$ between the sensor sets 320A and 320B and the longitudinal axis of the tool are known and (ii) the angle, θ, between the two sensor sets 320A and 320B is known. In the exemplary embodiment shown on FIG. 7, the accelerometers in sensor set 320A are parallel with corresponding accelerometers in sensor set 320B, although the invention is expressly not limited in this regard. Moreover, in the exemplary embodiment shown, one of the accelerometers in sensor set 320A is aligned radially in the housing 110 and another is aligned tangentially. Again, the invention is not limited in this regard.

With continued reference to the exemplary embodiments shown on FIG. 7, the total acceleration measured at each accelerometer in sensor sets 320A and 320B may be expressed as follows:

$$A_{X1} = A_{C1} - G_X \quad \text{Equation 16}$$

$$A_{Y1} = A_{T1} - G_Y \quad \text{Equation 17}$$

$$A_{X2} = -A_{T2}\sin\theta + A_{C2}\cos\theta - G_X \quad \text{Equation 18}$$

$$A_{Y2} = A_{T2}\cos\theta + A_{C2}\sin\theta - G_y \quad \text{Equation 19}$$

where $A_{X1}$, $A_{Y1}$, $A_{X2}$, and $A_{Y2}$ represent the total acceleration measured along the x and y axes at the first and second sensor sets (320A and 320B), $A_{C1}$ and $A_{C2}$ represent the centripetal accelerations at the first and second sensor sets, $A_{T1}$ and $A_{T2}$ represent the tangential accelerations at the first and second sensor sets, $G_X$ and $G_Y$ represent the x and y components of the total gravitational acceleration G, and θ represents the angle between the first and second sensor sets where $-\pi < \theta \leqq \pi$.

The gravitational components, $G_X$ and $G_Y$, may be canceled out by subtracting Equation 18 from Equation 16 and Equation 19 from Equation 17. The centripetal and tangential components of the total measured acceleration may then be expressed, for example, at the first sensor set 320A, as follows:

$$A_{C1} = \frac{d_1[(d_1 - d_2\cos\theta)(A_{X1} - A_{X2}) + d_2\sin\theta(A_{Y1} - A_{Y2})]}{(d_1 - d_2\cos\theta)^2 + (d_2\sin\theta)^2} \quad \text{Equation 20}$$

-continued $$A_{T1} = \frac{d_1[(d_1 - d_2\cos\theta)(A_{Y1} - A_{Y2}) + d_2\sin\theta(A_{X1} - A_{X2})]}{(d_1 - d_2\cos\theta)^2 + (d_2\sin\theta)^2} \quad \text{Equation 21}$$

where, $A_{X1}$, $A_{Y1}$, $A_{X2}$, $A_{Y2}$, $A_{C1}$, $A_{T1}$, and θ are as defined above with respect to Equations 16 through 19 and $d_1$ and $d_2$ represent corresponding radial distances between the first and second sensor sets 320A and 320B and the longitudinal axis of the housing 110. It will be appreciated that equations 16 through 19 may also be solved for $G_X$ and $G_Y$.

With further reference to FIG. 7, it will be understood to those of ordinary skill in the art, that the tangential and centripetal acceleration components $A_{C1}$ and $A_{T1}$ may be utilized to determine the rotation rate of the housing 110 in the borehole. For example, the rotation rate $R_H$ may be expressed in units of revolutions per minute as follows:

$$|R_H| = \frac{30}{\pi}\sqrt{\frac{A_{C1}}{d_1}} = \frac{30}{\pi}\sqrt{\frac{(d_1 - d_2\cos\theta)(A_{X1} - A_{X2}) + d_2\sin\theta(A_{Y1} - A_{Y2})}{(d_1 - d_2\cos\theta)^2 + (d_2\sin\theta)^2}} \quad \text{Equation 22}$$

$$R_H = \frac{30}{\pi}\int A_{T1}dt = \frac{30}{\pi}\int\frac{(d_1 - d_2\cos\theta)(A_{Y1} - A_{Y2}) - d_2\sin\theta(A_{X1} - A_{X2})}{(d_1 - d_2\cos\theta)^2 + (d_2\sin\theta)^2]}dt \quad \text{Equation 23}$$

where $A_{X1}$, $A_{Y1}$, $A_{X2}$, $A_{Y2}$, $A_{C1}$, $A_{T1}$, $d_1$, $d_2$, and θ are as defined above with respect to Equations 20 and 21 and $\int A_{T1}dt$ represents the integral of the tangential acceleration component $A_{T1}$, as a function of time. It will be appreciated that the tangential and centripetal acceleration components $A_{C2}$ and $A_{T2}$ could also be used determine the rotation rate of the housing in the borehole.

The centripetal and tangential accelerations $A_{C1}$ and $A_{T1}$ may also be advantageously utilized in combination to give a more accurate, vector valued rotation rate of the housing 110, for example, as follows:

$$R_H = sgn\left(\int A_{T1}dt\right)\frac{30}{\pi}\sqrt{\frac{A_{C1}}{d_1}} \quad \text{Equation 24}$$

where $R_H$, $A_{C1}$, $A_{T1}$, $d_1$, and $\int A_T dt$ are as given above with respect to Equations 22, and 23 and sgn( ) denotes a function that provides the sign (positive or negative) of $\int A_T dt$. As stated above with respect to Equation 1, $R_H$ may be utilized in combination with $R_{S\text{-}H}$ (the difference in the rotation rates of the shaft 115 and the housing 110, determined, for example, via sensor arrangement 200) to determine the rotation rate of the drill string 30 in the borehole. It will be appreciated that Equation 24 tends to advantageously provide an accurate, vector valued rotation rate (i.e., including both the absolute rotation rate and the direction of rotation).

While sensor sets 320A and 320B may be deployed substantially anywhere in the housing 110, provided they are disposed to measure cross-axial acceleration components, it will be understood that certain sensor set arrangements may be advantageous for various reasons. For example, it may be advantageous to position the sensor sets in nearly the same cross-axial plane (e.g., as shown on FIGS. 4 through 7).

Additionally, increasing the distance ($d_1$ or $d_2$) of at least one of the sensor sets 320A and 320B from the longitudinal axis increases the magnitude of the centripetal and tangential acceleration components at that sensor set and therefore tends to increase signal to noise ratio and improve accuracy. Other arrangements may be advantageously utilized in various pre-existing tools without requiring expensive retrofitting of the tool.

Moreover, certain sensor set arrangements may be advantageous due to their mathematical simplicity. For example, in an arrangement in which the sensor sets 320A and 320B are diametrically opposed, the centripetal and tangential acceleration components may be determined via Equations 14 and 15 or via Equations 4 and 8 when $d_1$32 $d_2$. In another exemplary arrangement in which $\theta$=90 degrees and $d_1$=$d_2$, the centripetal and tangential acceleration components, $A_C$ and $A_T$, may be given, for example, as follows:

$$A_C = \frac{(A_{X1} - A_{X2}) + (A_{Y1} - A_{Y2})}{2} \quad \text{Equation 25}$$

$$A_T = \frac{(A_{Y1} - A_{Y2}) - (A_{X1} - A_{X2})}{2} \quad \text{Equation 26}$$

In still another exemplary embodiment, sensor set 320A may be deployed centrally in the tool and sensor set 320B radially offset a known distance from the longitudinal axis. In such an embodiment, the centripetal and tangential acceleration components, $A_C$ and $A_T$, may be given for example, as follows:

$$A_C = A_{X1} - A_{X2} \quad \text{Equation 27}$$

$$A_T = A_{Y1} - A_{Y2} \quad \text{Equation 28}$$

It will be understood that $A_C$ and/or $A_T$ determined in Equations 25 through 28 may utilized to determine rotation rates as described in more detail above with respect to Equations 5, 9, and 22 through 24.

While FIGS. 5 through 7 do not show acceleration components due to tool shock and/or vibration in the borehole, it will be appreciated that Equations 4, 8, 14, 15, 20, 21, and 25 through 28 are also advantageously substantially free of such tool shock and/or vibration acceleration components. The artisan of ordinary skill in the art will readily recognize that at any given instant in time lateral tool acceleration is essentially unidirectional and may therefore be treated in an analogous manner to gravitational acceleration. As such, the tool vibration components cancel out in the same manner as the gravitational components. The artisan of ordinary skill will also recognize that the effect of acceleration components due to tool vibration in the borehole on the measured gravitational field may be accounted for utilizing substantially any known technique, for example, averaging $G_X$, $G_Y$, and/or $G_Z$ over some period of time.

As known to those of ordinary skill in the art, $G_X$ and $G_Y$, (and $G_Z$ for embodiments having at least one accelerometer aligned with the longitudinal axis of the tool) may be utilized to determine gravity tool face and inclination, for example, as follows:

$$GTF = \arctan\left(\frac{G_X}{G_Y}\right) = \arctan\left(\frac{A_{X1} + A_{X2}}{A_{Y1} + A_{Y2}}\right) \quad \text{Equation 29}$$

-continued $$Inc = \arctan\left(\frac{\sqrt{G_X^2 + G_Y^2}}{G_Z}\right) = \arccos\left(\frac{G_Z}{\sqrt{G_X^2 + G_Y^2 + G_Z^2}}\right) = \arccos(G_Z) \quad \text{Equation 30}$$

where GTF represents the gravity tool face, Inc represents the inclination, $G_X$, $G_Y$, and $G_Z$ represent the x, y, and z components of the gravitational field, and $A_{X1}$, $A_{X2}$, $A_{Y1}$, and $A_{Y2}$ are as defined above with respect to Equations 2, 3, 6, 7, and 16 through 19.

It will also be appreciated that the centripetal and tangential acceleration components (determined for example via various of the Equations presented above) may also be utilized to detect the onset of stick/slip and/or spin of the housing 110 during drilling (i.e., when the housing 110 is supposed to be substantially non-rotating). Such detection may be advantageous in controlling the steering tool 100, for example, by triggering the tool 100 to "re-grip" the borehole wall by further extending one or more of the blades 150. Exemplary embodiments of sensor arrangement 300 in combination with a controller (e.g., as described above with respect to FIG. 2) may thus essentially function as a closed-loop anti-rotation device for the housing 110.

The exemplary embodiments of the invention described above provide an apparatus and method of accurately determining the rotational rate of the nonfixed housing 110 of a steering tool 100. The resulting rotation rate can then be combined with a differential rate determined using systems known in the art (e.g., the Hall-effect sensor and magnets disclosed above). It will be understood that certain exemplary embodiments that the present invention may be located in a part of the steering tool that is rigidly coupled to the drill string (rather than or in addition to deployment in the nonfixed housing 110). As shown in FIG. 2, the nonfixed housing 110 does not extend along the entire length of the steering tool 100. There are parts of the steering tool 100 that are rigidly coupled to the drill string 30, and that rotate with the drill string 30 and shaft 115. Of particular interest is the near-bit stabilizer 120, shown near the bottom of the steering tool 100 in FIG. 2. For example, exemplary embodiments of sensor arrangement 300 shown and described above with respect to FIGS. 5 through 7 could be used in the near-bit stabilizer 120 (or in any other part of the bottom hole assembly that is rigidly coupled to the drill string). Embodiments in which the sensor sets are deployed in a portion of the bottom hole assembly that rotates with the drill string 30 (e.g., in near-bit stabilizer 120 shown on FIG. 2) may be advantageous in certain applications since the centripetal and tangential accelerations may be utilized to directly measure the rotation rate of the drill string. In such embodiments, rotation of the housing (which may be required, for example, to provide anti-rotation control of the housing as described above) may then be determined via equation 1 from the difference between the rotation rates of the shaft 115 and the housing 110 (determined, for example, via the Hall-effect sensor measurements described above) and the rotation rate of the drill string. In one such embodiment, accelerometer measurements may be transmitted from the shaft 115 to a controller located in the housing 110, for example, via a conventional low frequency induction wireless communication link. Rotation rates of the shaft and housing may then be computed, for example, as described above.

It will further be understood that the benefits of the present invention are not limited to steering tool 100 applications. In real world drilling situations, the entire bottom hole assembly often rotates in a non-uniform manner, with sticking and slipping being somewhat common occurrences. The present invention, therefore, can also be used to great benefit in substantially any downhole tool that does not have nonfixed housings or members. Indeed, most downhole tools are unitary designs in which multiple tool components are rigidly connected together. Such tools must rotate with the drill string. Due to the length of the drill string, which often exceeds 10,000 feet in many applications, and the existence of stick/slip conditions, it is advantageous to use the present invention to improve the determination of actual drill string rotation rates anywhere within the bottom hole assembly.

One such application of the present invention might be in an MWD survey tool. In such embodiments, the rotation rate and survey parameters, such as gravity tool face and inclination, may be determined in the same manner as described above. The improved accuracy of these determinations may improve the quality of the resulting survey. Another application may be in an LWD tool where accurate determination of drill rotation rate may be advantageous.

Figure 8:
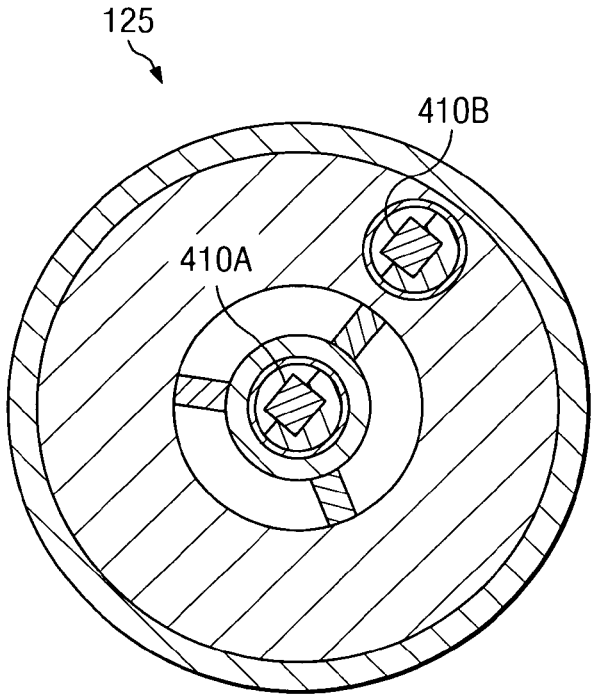
FIG. 8 depicts, in cross section, an exemplary sensor arrangement placed in a downhole tool in accordance with this invention.

Referring now to FIG. 8 an embodiment of the present invention in a downhole tool 125 that rotates with the drill string 30 (e.g., an MWD survey tool, as described in the preceding paragraph) is shown. In the exemplary embodiment shown, sensor arrangement 400 (FIG. 1) includes a first sensor set 410A deployed substantially centrally in a downhole tool 125 (i.e., at or near the longitudinal axis) and a second sensor set 410B radially offset a known distance from the longitudinal axis, although, as described above, the invention is not limited in this regard. Other suitable sensor set arrangements include, for example, those shown and described above with respect to FIGS. 5 through 7. Each sensor set 410A and 410B includes at least one accelerometer disposed to measure cross-axial acceleration components as also described above with respect to FIGS. 5 through 7. In one advantageous embodiment, each sensor set 410A and 410B includes first and second orthogonal accelerometers (although the invention is not limited in these regards).

Suitable accelerometers for use in sensors 300 and 400 (FIG. 1) are preferably chosen from among commercially available devices known in the art. For example, suitable accelerometers may include Part Number 979-0273-001 commercially available from Honeywell, and Part Number JA-5H175-1 commercially available from Japan Aviation Electronics Industry, Ltd. (JAE). Suitable accelerometers may alternatively include micro-electro-mechanical systems (MEMS) solid-state accelerometers, available, for example, from Analog Devices, Inc. (Norwood, Mass.). Such MEMS accelerometers may be advantageous for certain steering tool applications since they tend to be shock resistant, high-temperature rated, and inexpensive.

Figure 9:
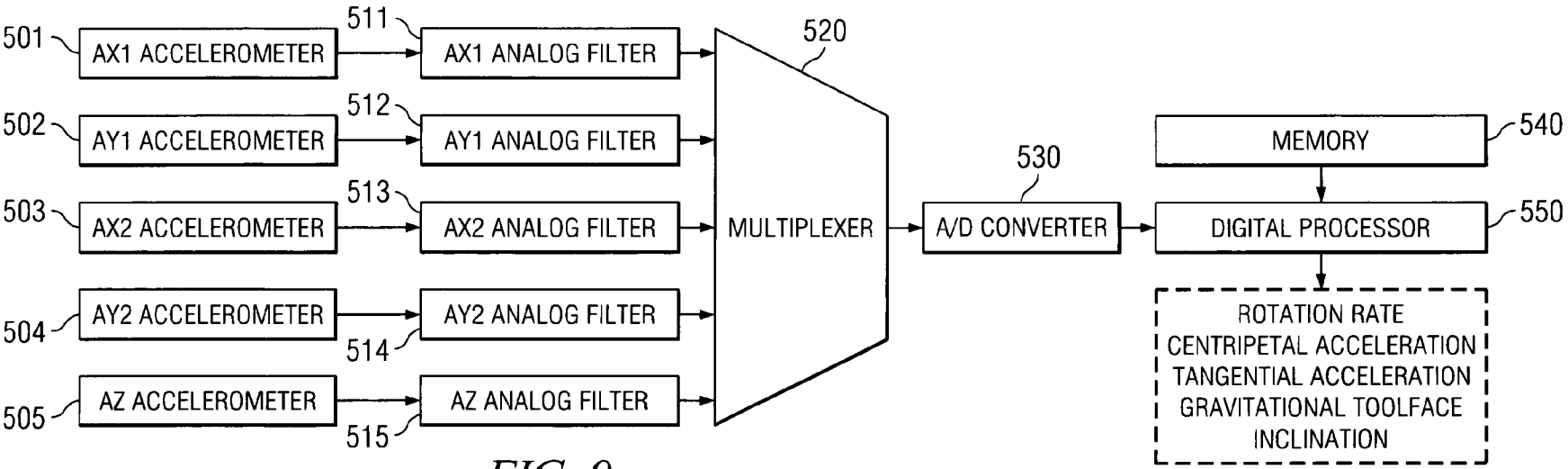
FIG. 9 depicts a block diagram of an exemplary control circuit in accordance with the present invention.

Referring now to FIG. 9, a block diagram of one exemplary embodiment of an accelerometer signal processing circuit 500 in accordance with this invention is shown. It will be understood that signal processing circuit 500 is configured for use with a sensor arrangement similar to that shown on FIG. 7 in which one of the sensor sets 310A" or 310B" includes a tri-axial arrangement of accelerometers. It will be further understood that signal processing aspects of this invention are not limited to use with sensors having any particular number of accelerometers. In the exemplary circuit embodiment shown, accelerometers 501-505 are electrically coupled to low-pass filters 511-515. The filters 511-515 may also function to convert the accelerometer output from current signals to voltage signals. The filtered voltage signals are coupled to an A/D converter 530 through multiplexer 520 such that the output of the A/D converter 530 includes digital signals representative of low-pass filtered accelerometer values. In one exemplary embodiment, A/D converter 530 includes a 16-bit A/D device, such as the AD7654 available from Analog Devices, Inc. (Norwood, Mass.).

In the exemplary embodiment shown, A/D converter 530 is electronically coupled to a digital processor 550, for example, via a 16-bit bus. Substantially any suitable digital processor may be utilized, for example, including an ADSP-2191M microprocessor, available from Analog Devices, Inc. It will be understood that while not shown in FIGS. 1 through 8, steering tool embodiments of this invention typically include an electronic controller. Such a controller typically includes signal processing circuit 500 including digital processor 550, A/D converter 530 and a processor readable memory device 540, and/or a data storage device. The controller may also include processor-readable or computer-readable program code embodying logic, including instructions for continuously computing instantaneous drill string rotation rates. Such instructions may include, for example, the algorithms set forth above in Equations 1 through 9, 14, and 17 through 21. The controller typically further includes instructions to receive rotation-encoded commands from the surface and to cause the tool 100 to execute such commands upon receipt. The controller may further include instructions for computing gravity tool face and borehole inclination, for example, as set forth above in Equations 10 through 13, 15, and 16.

A suitable controller typically includes a timer including, for example, an incrementing counter, a decrementing time-out counter, or a real-time clock. The controller may further include multiple data storage devices, various sensors, other controllable components, a power supply, and the like. The controller may also include conventional receiving electronics, for receiving and amplifying pulses from sensor arrangement 200. The controller may also optionally communicate with other instruments in the drill string, such as telemetry systems that communicate with the surface. It will be appreciated that the controller is not necessarily located in the steering tool 100, but may be disposed elsewhere in the drill string in electronic communication therewith. Moreover, one skilled in the art will readily recognize that the multiple functions described above may be distributed among a number of electronic devices (controllers).

It will be appreciated that exemplary embodiments of steering tool 100 may decode drill string rotation rate encoded commands using substantially any known techniques. The encoded commands may include substantially any steering tool commands, for example, including commands that cause the steering tool to extend and/or retract one or more of the blades 150 (FIG. 2). Such techniques include, for example, those disclosed by Webster in U.S. Pat. No. 5,603,386 and Baron et al. in U.S Publication No. 2005/0001737 (which is commonly assigned with the present invention). Such techniques may also include encoding tool commands in a combination of drill string rotation rate and drilling fluid flow rate variations as disclosed in commonly assigned U.S patent application Ser. No. 11/062,299 to Jones et al.

Figure 10:
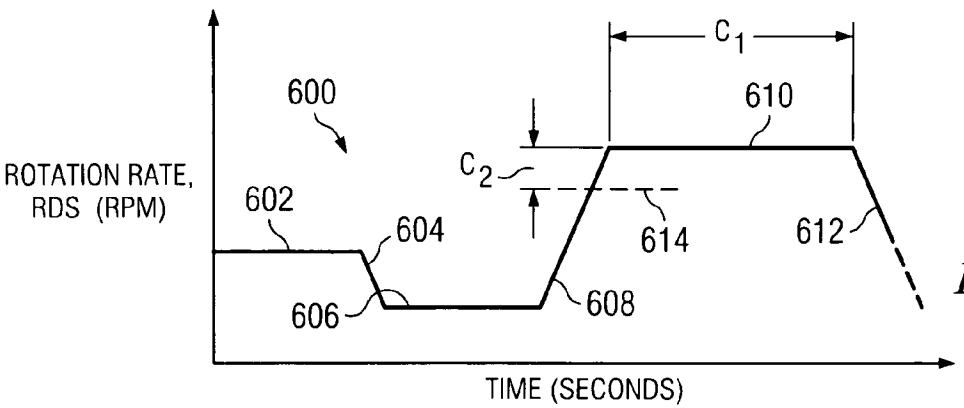
FIG. 10 depicts an exemplary rotation rate waveform suitable for encoding a steering tool wakeup command in accordance with the present invention.
Figure 11:
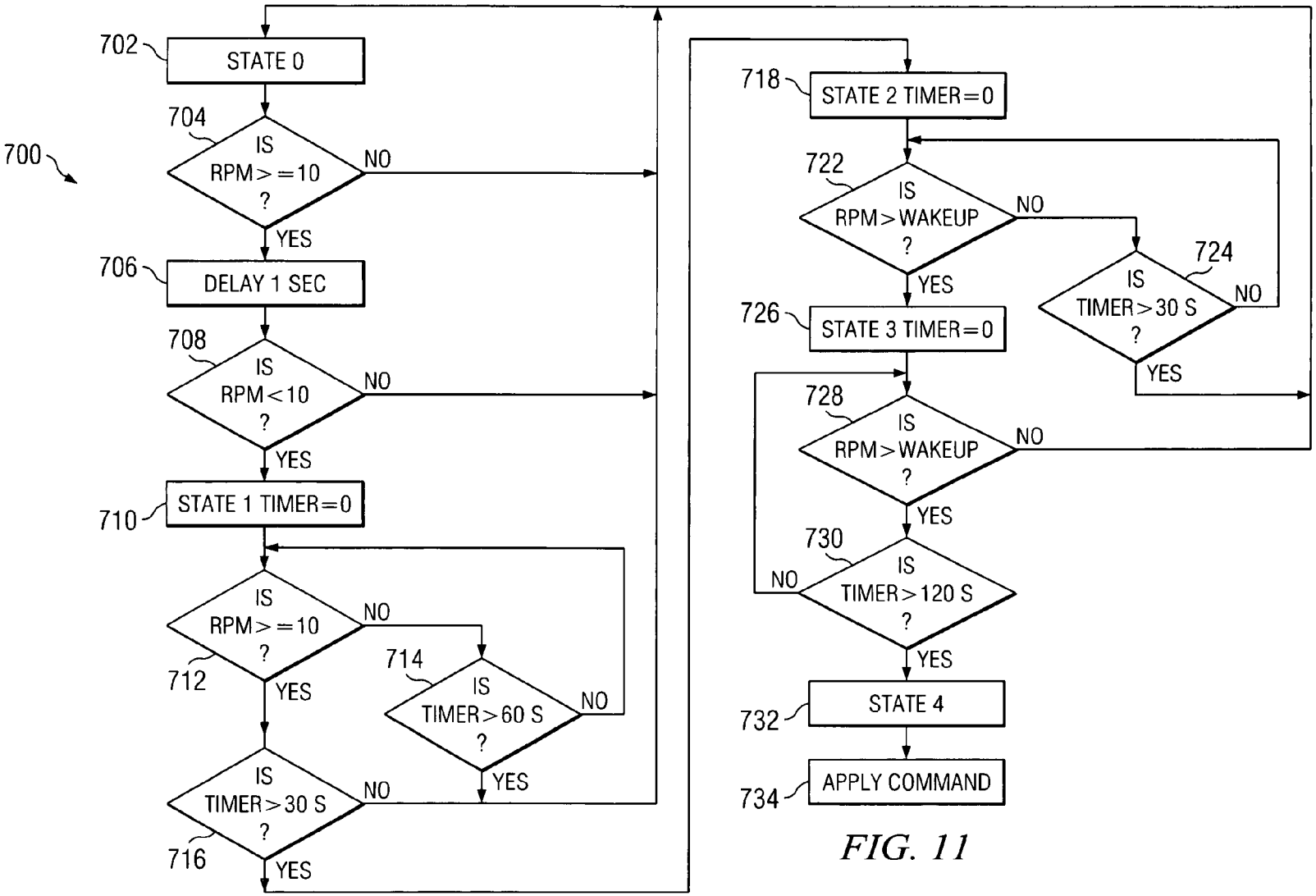
FIG. 11 depicts a flow diagram illustrating one exemplary method embodiment in accordance with the present invention suitable for decoding the waveform shown on FIG. 10.

Reference should now be made to FIGS. 10 and 11. In the exemplary embodiment shown, an encoded steering tool wakeup command is represented as a combination of a predefined sequence of varying rotation rates of the drill string. Such a sequence is referred to herein as a "code sequence." The encoding scheme may define one or more codes (e.g., a tool command) as a function of one or more measurable parameters of a code sequence, (e.g., the rotation rates at predefined times in the code sequence as well as the duration of predefined portions of the code sequence).

It will be understood by those of ordinary skill in the art, that during certain portions of a directional drilling job a steering tool (such as exemplary embodiments of steering tool 100 described above with respect to FIGS. 1 through 9) may be advantageously deactivated (i.e., asleep). In such a configuration, the steering tool blades are typically fully retracted into the housing and the housing is further typically free to rotate relative to both the borehole and the drill string (i.e., the shaft). It will also be understood that during such portions of the drilling job, it is disadvantageous to accidentally wake the steering tool. For example, waking the tool while the drill string is being tripped into the borehole can cause the drill string to become lodged in the borehole or may even cause damage to the steering tool (e.g., from the blades attempting to engage the borehole wall). At other times it may be disadvantageous to wake the steering tool during routine drilling applications, such as drilling out a shoe track or a reaming operation. Conventionally, a simple rotation rate threshold has been used to wake a steering tool. However, during stick/slip conditions (or during routine drilling applications such as those described above), the threshold RPM is sometimes exceeded, which inadvertently wakes the tool.

With reference to FIG. 10, one exemplary embodiment of a rotation rate encoded wakeup command is represented by rotation rate waveform 600. The vertical scale indicates the rotation rate of the drill string (e.g., as determined in Equation 1 or Equation 21 and measured in revolutions per minute (RPM)). The horizontal scale indicates relative time in seconds measured from an arbitrary reference. Waveform 600 includes a preliminary rotation rate 602, followed by a reduction 604 of the rotation rate to near-zero 606 for at least a predetermined time prior to a rotation rate pulse 610. In this exemplary embodiment a pulse is defined as an increase 608 from the near-zero level 606 to an elevated level 610 for at least a specified period of time. The pulse may optionally be followed by a decrease 612 to the near-zero level 606 (the invention is not limited in these regards). The use of a near-zero rotation rate prior to the rotation rate pulse advantageously enables the code sequence to be further validated, which may be advantageous in applications having significant noise (e.g., in the presence of stick/slip conditions, as described in the Background Section above).

In the exemplary embodiment shown on FIG. 10, waveform 600 includes a first code $C_1$ that is defined as a function of the measured duration of the rotation rate pulse and a second code $C_2$ that is defined as a function of the difference between the rotation rate at the elevated level 610 and a predefined wakeup level 614. In the exemplary embodiment shown, a valid wakeup command includes a number of elements. First a preliminary rotation rate 602 must be achieved. Second, a near-zero rotation rate 606 must be maintained for some period of time (e.g., between 30 and 60 seconds). Third, a rotation rate greater than some level $C_2$ (e.g., 10 RPM) above the predefined wakeup level 614 must be maintained for at least a predetermined time period $C_1$ (e.g., 120 seconds). The use of a near-zero rotation rate 606 prior to an elevated rotation rate for a duration of time tends to advantageously prevent inadvertent waking of the steering tool due to the occurrence of stick/slip conditions. Moreover, the use of sensor arrangements 200 and 300 or sensor arrangement 400, which enable substantially instantaneous measurement of the rotation rate of the drill string, also tends to eliminate inadvertent waking of the tool.

Referring now to FIG. 11, a flow diagram of one exemplary method embodiment 700 for decoding a wakeup command in accordance with the present invention is illustrated. In the exemplary embodiment shown, the method is implemented as a state machine that is called once each second to execute a selected portion of the program to determine whether a change in state is in order. Method 700 is suitable to be used to decode the exemplary steering tool wakeup command described above with respect to FIG. 10. It will be understood that the invention is expressly not limited by the exemplary embodiment described herein.

With continued reference to the flow diagram of FIG. 11, "STATE", "RPM", and "TIMER" refer to variables stored in local memory (e.g., memory 540 in FIG. 9). Method embodiment 700 functions similarly to a state-machine with STATE indicating the current state. As the code sequence is received and decoded, STATE indicates the current relative position within the incoming code sequence. RPM represents the most recently measured value for the rotation rate of the drill string (e.g., as determined by Equation 1). In the exemplary embodiment shown, RPM is updated once each second by an interrupt driven software routine (running in the background) that computes the average rotation rate for the previous 20 seconds. This interrupt driven routine works in tandem with other interrupt driven routines (also running in the background) that are executed (with reference to FIG. 3), for example, each time sensor 210 detects a marker 215 and determines the elapsed time since the previous instant the marker was detected and each time accelerometer outputs 501-505 are digitized (FIG. 9). As described above, Equation 1 may then be used to determine the rotation rate of the drill string. It will be appreciated that TIMER does not refer to the above described elapsed time, but rather to a variable stored in memory that records the time in seconds elapsed following the execution of certain predetermined method steps. In the exemplary embodiment shown, TIMER is updated once each second by a software subroutine.

Method 700 begins at 702 at which STATE is set to 0 to indicate that a near-zero rotation rate has not yet been established. At STATE 0, method 700 repeatedly checks to determine whether or not RPM is greater than or equal to 10 at 704, and following a one second delay at 706, whether or not RPM is less than 10. When both conditions are met, STATE is set equal to 1 and TIMER is set equal to 0 at 710.

At STATE 1 the program waits for an increase in the rotation rate above 10 rpm. If a valid code sequence has been initiated, RPM will remain below 10 rpm for a period of between 30 and 60 seconds. During this time, RPM is repeatedly sampled (e.g., once per second) at 712 to determine whether it has increased above 10 rpm. At 712, if RPM has not increased above 10 rpm within 60 seconds STATE is again set to 0. At 714, if RPM increases above 10 rpm in less than 30 seconds, STATE is also set to 0. If RPM increases above 10 rpm after an interval of between 30 and 60 seconds, STATE is set to 2 and TIMER is again set to 0 at 718.

At STATE 2 the program waits for an increase in the rotation rate above the predefined wakeup threshold rotation rate. If a valid wakeup command has been transmitted, RPM will achieve the threshold rate in less than 30 seconds. RPM is repeatedly sampled at 722 to determine whether it has increased above the wakeup threshold. At 724, if RPM remains below the wakeup threshold for at least 30 seconds, STATE is again set to zero. If RPM is greater than the threshold, STATE is set to 3 and TIMER is set to 0 at 726.

At STATE 3 the program repeatedly checks RPM at 728. If a valid wakeup command has been transmitted, RPM will remain above the wakeup threshold for a period of at least 120 seconds. If RPM falls below the wakeup threshold, STATE is again set to 0. At 732 the time period is checked. After 120 seconds have passed (with RPM greater than the wakeup threshold), STATE is set equal to 4 at 732 and the controller applies the wakeup command at 734. While the invention is not limited in this regard, applying a wakeup command typically includes pressurizing the hydraulic chamber(s) in the hydraulic module 130 (FIG. 2), extending the blades 150 (FIG. 2) into contact with the borehole wall 42 (FIG. 1), and activating the controller to receive additional steering tool commands (e.g., tool face and offset settings).

Although the present invention and its advantages have been described in detail, it should be understood that various changes, substitutions and alternations can be made herein without departing from the spirit and scope of the invention as defined by the appended claims.

I claim:

1. A downhole steering tool, configured to operate in a borehole, comprising:

a shaft;

a housing deployed about the shaft, the housing and shaft disposed to rotate substantially freely with respect to one another;

a plurality of blades deployed on the housing, the blades disposed to extend radially outward from the housing and engage a wall of the borehole, said engagement of the blades with the borehole wall operative to eccenter the housing in the borehole; and, first and second sensor sets deployed at corresponding first and second positions in the housing and disposed, in combination, to measure a substantially real-time rotation rate of the housing in the borehole, each of the sensor sets including at least one accelerometer disposed to measure a cross-axial acceleration component.

2. The steering tool of claim 1, further comprising a differential rotation rate sensor disposed to measure a difference in rotation rates between the shaft and the housing.

3. The steering tool of claim 1, wherein:

the first and second positions are located along a common diameter of the housing; and at least one accelerometer in the first sensor set is positioned substantially parallel with at least one accelerometer in the second sensor set.

4. The steering tool of claim 1, wherein each sensor set comprises first and second orthogonal accelerometers.

5. The steering tool of claim 1, wherein at least one of the sensor sets comprises a tri-axial arrangement of accelerometers, one of the accelerometers being substantially aligned with the longitudinal axis of the steering tool.

6. The steering tool of claim 1, wherein the first sensor set is located a first distance from a longitudinal axis of the housing and the second sensor set is located a second distance from the longitudinal axis of the housing, the first distance being greater than the second distance.

7. The steering tool of claim 1, wherein the first and second sensor sets are deployed at a known angle with respect to one another about a longitudinal axis of the housing, the known angle being less than 180 degrees.

8. The steering tool of claim 1, further comprising a controller configured to:

(a) receive measured cross-axial acceleration components from the first and second sensor sets;

(b) process the measured cross-axial acceleration components to determine the substantially real-time rotation rate of the housing; and (c) process the substantially real-time rotation rate of the housing to determine a substantially real-time rotation rate of a drill string.

9. The steering tool of claim 8, wherein the controller is further configured to determine gravity tool face and inclination of the housing from the measured cross-axial acceleration components.

10. The steering tool of claim 1, further comprising a controller configured to send a signal that results in the outward extension of one or more of the blades from the housing when the rotation rate of the housing is greater than a predetermined threshold rate, said outward extension of the one or more blades operative to substantially prevent continued rotation of the housing.

11. A downhole tool comprising:

a housing including a longitudinal axis, the housing configured for being coupled to and rotating with a drill string in a subterranean borehole;

first and second sensor sets deployed in the housing and disposed, in combination, to measure a substantially real-time rotation rate of the housing about the longitudinal axis, the first sensor set located a first distance from the longitudinal axis and the second sensor set located a second distance from the longitudinal axis, the first distance greater than the second distance; and each of the sensor sets including at least one accelerometer disposed to measure cross-axial acceleration components in the housing.

12. The downhole tool of claim 11, wherein the second sensor set is located substantially on the longitudinal axis of the housing and the first sensor set is radially offset a known distance from the longitudinal axis.

13. The downhole tool of claim 11, wherein each sensor set comprises first and second orthogonal accelerometers.

14. The downhole tool of claim 11, wherein each at least one accelerometer in the first sensor set is substantially parallel with a corresponding accelerometer in the second sensor set.

15. The steering tool of claim 11, wherein at least one of the sensor sets comprises a tri-axial arrangement of accelerometers, one of the accelerometers being substantially aligned with the longitudinal axis of the steering tool.

16. The steering tool of claim 11, wherein the first and second sensor sets are diametrically opposed in the housing.

17. The steering tool of claim 11, wherein the first and second sensor sets are deployed at a known angle with respect to one another about the longitudinal axis, the known angle being less than 180 degrees.

18. The steering tool of claim 11, further comprising a controller configured to (i) receive measured cross-axial acceleration components from the first and second sensor sets, and (ii) process the measured cross-axial acceleration components to determine the substantially real-time rotation rate of the housing.

19. A downhole tool comprising:

a housing including a longitudinal axis, the housing configured for being coupled to and rotating with a drill string in a subterranean borehole;

first and second sensor sets deployed in the housing and disposed in combination, to measure a substantially real-time rotation rate of the housing about the longitudinal axis, the first and second sensor sets deployed at a known angle with respect to one another about the longitudinal axis, the known angle being less than 180 degrees; and each of the sensor sets including first and second accelerometers disposed to measure cross-axial acceleration components in the housing.

20. The downhole tool of claim 19, wherein the known angle is approximately 90 degrees.

21. The steering tool of claim 19, wherein the first sensor set and the second sensor set are spaced substantially equal distance from the longitudinal axis.

22. The downhole tool of claim 19, wherein each sensor set comprises first and second orthogonal accelerometers.

23. the downhole tool of claim 19, wherein at least one accelerometer in the first sensor set is substantially parallel with a corresponding accelerometer in the second sensor set.

24. The downhole tool of claim 19, wherein at least one of the sensor sets comprises a tri-axial arrangement of accelerometers, one of the accelerometers being substantially aligned with the longitudinal axis of the steering tool.

25. The steering tool of claim 19, further comprising a controller configured to (i) receive measured cross-axial acceleration components from the first and second sensor sets, and (ii) process the measured cross-axial acceleration components to determine the substantially real-time rotation rate of the housing.

26. A downhole steering tool comprising:

a shaft;

a housing deployed about the shaft, the shaft and the housing disposed to rotate substantially freely with respect to one another;

a plurality of blades deployed on the housing, the blades disposed to extend radially outward from the housing and engage a borehole wall, said engagement of the blades with the borehole wall operative to eccenter the housing in the borehole;

a first rotation rate sensor disposed to measure a difference between the rotation rates of the shaft and the housing; and a second rotation rate sensor disposed to measure a rotation rate of the shaft, the second rotation rate sensor including first and second sensor sets deployed at corresponding first and second positions in a portion of the steering tool that is rotationally coupled with the shaft, each of the sensor sets including at least one accelerometer disposed to measure a cross-axial acceleration component.

27. The steering tool of claim 26, further comprising a controller configured to:

(a) receive measured cross-axial acceleration components from the first and second sensor sets;

(b) process the measured cross-axial acceleration components to determine the rotation rate of the shaft;

(c) process (i) the rotation rate of the shaft and (ii) the difference between the rotation rate of the shaft and the rotation rate of the housing to determine a rotation rate of the housing.

28. The steering tool of claim 27, wherein the controller is further configured to send a signal that results in the outward extension of one or more of the blades from the housing when the rotation rate of the housing is greater than a predetermined threshold rate, said outward extension of the one or more blades operative to substantially prevent continued rotation of the housing.

29. An anti-rotation device for a steering tool comprising:

a non-fixed housing deployed about a shaft and disposed to rotate substantially freely with respect to the shaft;

a plurality of blades deployed on the housing, the blades disposed to extend outward from the housing into contact with a borehole wall, said outward extension of the blades operative to eccenter the housing in the borehole;

first and second sensor sets deployed in the housing and disposed, in combination, to measure a substantially real-time rotation rate of the housing about its longitudinal axis, each of the sensor sets including at least one accelerometer disposed to measure a cross-axial acceleration component; and a controller configured to send a signal that results in the outward extension of at least one of the blades from the housing when the rotation rate of the housing is greater than a predetermined threshold rate, said outward extension of the blades operative to substantially prevent continued rotation of the housing.

30. The steering tool of claim 29, wherein the first sensor set is located a first distance from a longitudinal axis of the housing and the second sensor set is spaced a second distance from the longitudinal axis of the housing, the first distance being greater than the second distance.

31. The steering tool of claim 29, wherein the first and second sensor sets are deployed at a known angle with respect to one another about a longitudinal axis of the housing, the known angle being less than 180 degrees.

32. A method of controlling a steering tool deployed in a subterranean borehole, the method comprising:

(a) deploying a drill string in a subterranean borehole, the drill string including a steering tool connected thereto, the drill string being rotatable about a longitudinal axis, the steering tool including a shaft deployed to rotate substantially freely in a housing, the steering tool including a rotation measurement device operative to measure a difference in rotation rates between the shaft and the housing, the steering tool further including first and second sensor sets deployed in the housing and disposed, in combination, to measure the rotation rate of the housing, each of the first and second sensor sets including at least one accelerometer disposed to measure cross-axial acceleration components;

(b) causing the drill string to rotate at a preselected rotation rate;

(c) causing the rotation measurement device to measure the difference in rotation rates between the shaft and the housing;

(d) causing the first and second sensor sets to measure the rotation rate of the housing; and (e) processing downhole the difference in rotation rates acquired in (c) and the rotation rate of the housing acquired in (d) to determine a rotation rate of the drill string.

33. The method of claim 32, wherein (d) further comprises:

i) causing the first and second sensor sets to measure cross-axial acceleration components;

ii) processing downhole the cross-axial acceleration components to determine at least one member of the group consisting of a centripetal acceleration component and a tangential acceleration component; and iii) processing downhole at least one of the centripetal acceleration component and the tangential acceleration component to determine the rotation rate of the housing.

34. The method of claim 33, wherein (d) further comprises:

iv) processing the cross-axial acceleration components to determine at least one cross-axial component of a gravitational field; and v) processing the cross-axial component of the gravitational field to determine an inclination and a gravity tool face of the steering tool in the borehole.

35. The method of claim 32, further comprising:

(f) causing the steering tool to selectively extend or retract at least one steering tool blade out from or into the housing.

36. A method of communicating a wakeup command to a steering tool deployed in a subterranean borehole, the method comprising:

(a) deploying a drill string in a subterranean borehole, the drill string including a steering tool connected thereto, the drill string being rotatable about a longitudinal axis, the steering tool including a shaft deployed to rotate substantially freely in a housing, the steering tool including a first rotation measurement device operative to measure a difference in rotation rates between the shaft and the housing and a second rotation measurement device operative to measure a rotation rate of the housing, the second rotation measurement device including a plurality of accelerometers, each of which is disposed to measure cross-axial acceleration components;

(b) predefining an encoding language comprising codes understandable to the steering tool, the codes represented in said language as predefined value combinations of drill string rotation variables, the drill string rotation variables including first and second drill string rotation rates;

(c) causing the drill string to rotate through a predefined sequence of varying rotation rates, such sequence representing the wakeup command;

(d) causing the first rotation measurement device to measure the difference in rotation rates between the shaft and the housing;

(c) causing the second rotation measurement device to measure the rotation rate of the housing;

(f) processing downhole the difference in rotation rates measured in (d) and the rotation rate of the housing measured in (e) to determine a rotation rate of the drill string; and (g) processing downhole the rotation rate of the drill string determined in (f) to acquire the wakeup command.

37. The method of claim 36, wherein the second rotation rate measurement device comprises first and second sensor sets deployed in the housing, each of the sensor sets including at least one accelerometer disposed to measure cross-axial acceleration components.

* * * * *